US011856381B2

(12) United States Patent
Akiyama et al.

(10) Patent No.: US 11,856,381 B2
(45) Date of Patent: Dec. 26, 2023

(54) VIBRATION DEVICE

(71) Applicant: AGC Inc., Tokyo (JP)

(72) Inventors: Jun Akiyama, Tokyo (JP); Kento Sakurai, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 17/701,624

(22) Filed: Mar. 22, 2022

(65) Prior Publication Data

US 2022/0217470 A1 Jul. 7, 2022

Related U.S. Application Data

(63) Continuation of application No. PCT/JP2020/035598, filed on Sep. 18, 2020.

(30) Foreign Application Priority Data

Sep. 27, 2019 (JP) ..... 2019-177814

(51) Int. Cl.

| | |
|---|---|
| ***H04R 7/08*** | (2006.01) |
| ***H04R 1/02*** | (2006.01) |
| ***H04R 1/28*** | (2006.01) |
| ***H04R 7/18*** | (2006.01) |
| ***H04R 7/26*** | (2006.01) |

(52) U.S. Cl.

CPC ..... *H04R 7/08* (2013.01); *H04R 1/025* (2013.01); *H04R 1/288* (2013.01); *H04R 7/18* (2013.01); *H04R 7/26* (2013.01); *H04R 2307/023* (2013.01)

(58) Field of Classification Search

CPC . H04R 7/08; H04R 7/18; H04R 1/288; H04R 1/025

See application file for complete search history.

(56) References Cited

FOREIGN PATENT DOCUMENTS

JP H05-227590 A 9/1993
WO WO-2018181626 A1 * 10/2018 ..... H04R 7/06

OTHER PUBLICATIONS

Mal et al., "A Novel Glass Laminated Structure for Flat Panel Loudspeakers," Audio Engineering Society, presented at the 124th Convention, Amsterdam, The Netherlands, May 17-20, 2008, pp. 1-6.

International Searching Authority, "International Search Report," issued in connection with International Patent Application No. PCT/JP2020/035598, dated Dec. 22, 2020.

International Searching Authority, "Written Opinion," issued in connection with International Patent Application No. PCT/JP2020/035598, dated Dec. 22, 2020.

* cited by examiner

*Primary Examiner* — Sunita Joshi

(74) *Attorney, Agent, or Firm* — Foley & Lardner LLP

(57) ABSTRACT

A vibration device includes: a glass diaphragm; an exciter which is fixed to the glass diaphragm and vibrates the glass diaphragm; an enclosing member which defines an internal space by enclosing a portion, including a fixing position of the exciter, of the glass diaphragm, one end portion of the glass diaphragm being exposed to outside the internal space through an opening of the internal space; and a shielding member for acoustic shielding between the opening and the glass diaphragm, the shielding member dividing the glass diaphragm into an excitation region located inside the internal space and a vibration region located outside the internal space.

18 Claims, 13 Drawing Sheets

VIBRATION DEVICE

CROSS-REFERENCE TO RELATED APPLICATIONS

This is a bypass continuation of International Patent Application No. PCT/JP2020/035598, filed on Sep. 18, 2020, which claims priority to Japanese Patent Application No. 2019-177814, filed on Sep. 27, 2019. The contents of these applications are hereby incorporated by reference in their entireties.

The present invention relates to a vibration device for exciting a glass diaphragm.

BACKGROUND ART

Generally, cone paper and resin are used broadly as materials of diaphragms for speakers. Being large in loss coefficient and less prone to resonance vibration, these materials are high in sound reproduction performance in the audible range. However, since these materials are themselves low in acoustic velocity, when they are excited at a radio frequency, vibration occurring in the materials does not easily follow a sound wave frequency, possibly causing divided vibration. As a result, these materials cause difficulty obtaining a desired sound pressure particularly in a radio frequency range.

It is being studied to use, to produce a diaphragm, instead of cone paper or resin, materials that are high in acoustic velocity they propagate, such as metals, ceramic, and glass.

Among such materials are a single glass sheet for a speaker diaphragm (Patent document 1) and laminate glass in which a 0.5-mm-thick polybutyl-type polymer layer is sandwiched between two glass sheets (Non-patent document 1).

CITATION LIST

Patent Literature

Patent document 1: JP-A-5-227590

Non-Patent Literature

Non-patent document 1: Olivier Mal et. al., "A Novel Glass Laminated Structure for Flat Panel Loudspeakers," AES Convention 124, 7343.

SUMMARY OF INVENTION

Technical Problems

The above speakers which use a glass diaphragm have a structure that an exciter is attached to a single, continuous glass diaphragm. Thus, the discrimination between an excitation region where the exciter is provided and a vibration region that emits acoustic radiation is not clear. As a result, noise generated by vibration in the excitation region is superimposed on sound generated in the vibration region, whereby an intensity distribution is formed in sound pressure produced in a neighboring space by acoustic radiation from the glass diaphragm. Furthermore, the directivity is lowered by going-around of sound.

In view of the above, an object of the present invention is to provide a vibration device capable of forming a uniform sound pressure distribution, providing a good frequency characteristic, and suppressing reduction in directivity in performing excitation using a glass diaphragm.

Solution to Problem

As a result of making diligent studies, the present inventors have completed the invention by finding out that the above problems can be solved by employing a structure that prevents vibration generated in an excitation region of a glass diaphragm from traveling to the neighboring space by air propagation by disposing the excitation region in a closed space that is an inside space of an enclosing member and thereby clearly dividing the excitation region and a vibration region from each other.

That is, the invention provides the following:

A vibration device including:

a glass diaphragm;

an exciter which is fixed to the glass diaphragm and vibrates the glass diaphragm;

an enclosing member which defines an internal space by enclosing a portion, including a fixing position of the exciter, of the glass diaphragm, one end portion of the glass diaphragm being exposed to outside the internal space through an opening of the internal space; and a shielding member for acoustic shielding between an edge of the opening and the glass diaphragm, the shielding member dividing the glass diaphragm into an excitation region located inside the internal space and a vibration region located outside the internal space.

Advantageous Effects of Invention

The invention can provide a vibration device capable of forming a uniform sound pressure distribution and suppressing reduction in directivity in performing excitation using a glass diaphragm.

BRIEF DESCRIPTION OF DRAWINGS

FIG. 18A is a sectional view showing a state that the glass vibrator is curved so as to assume a concave shape and FIG. 18B is a sectional view showing a state that the glass vibrator is curved so as to assume a convex shape.

DESCRIPTION OF EMBODIMENTS

Figure 1:
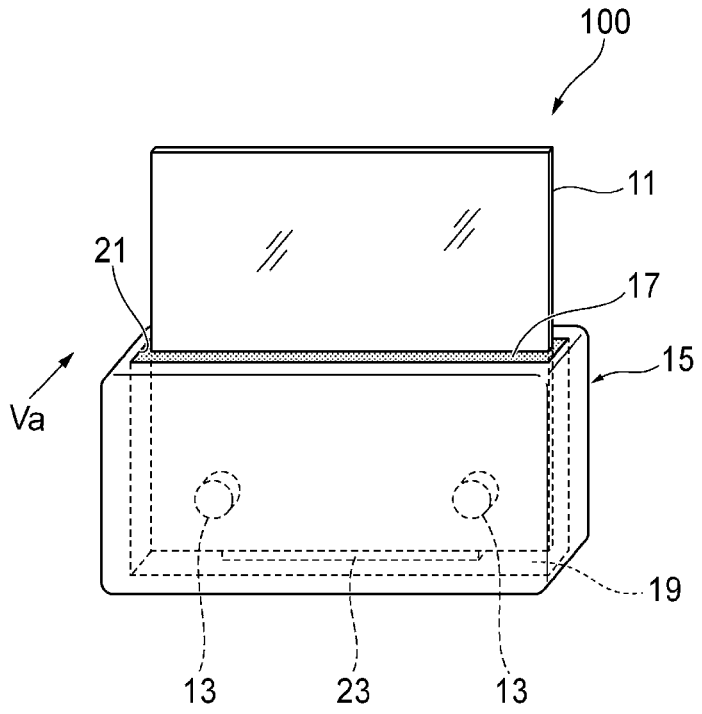
FIG. 1 is a schematic perspective view showing an external shape of a vibration device according to the present invention having a first example configuration.

Embodiments of the present invention is hereinafter described in detail with reference to the drawings. In the drawings to be referred to below, members or components that are identical or correspond to each other are given the same symbol or corresponding symbols and redundant descriptions therefor will be omitted. The drawings are not intended to show relative sizes between members or components unless otherwise specified. Thus, specific dimensions can be selected as appropriate by referring to the following non-restrictive embodiments.

In the specification, the mark "-" (or the word "to") that is used to indicate a numerical range indicates a range that includes the numerical values written before and after it as a lower limit value and an upper limit value, respectively.

In this specification, the terms "mass" and "weight" are the same in meaning.

First Example Configuration

Figure 2:
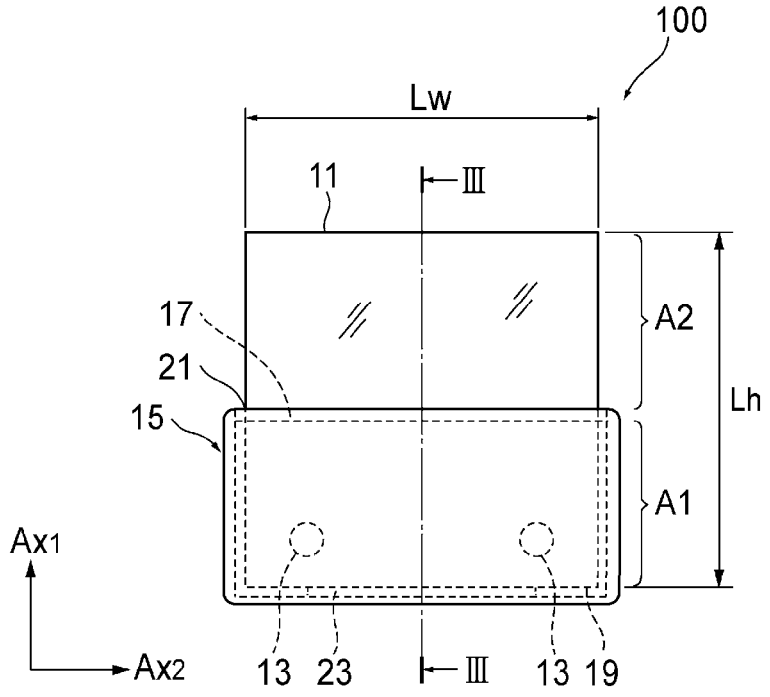
FIG. 2 is a front view, as viewed from the direction indicated by arrow Va, of the vibration device shown in FIG. 1.
Figure 3:
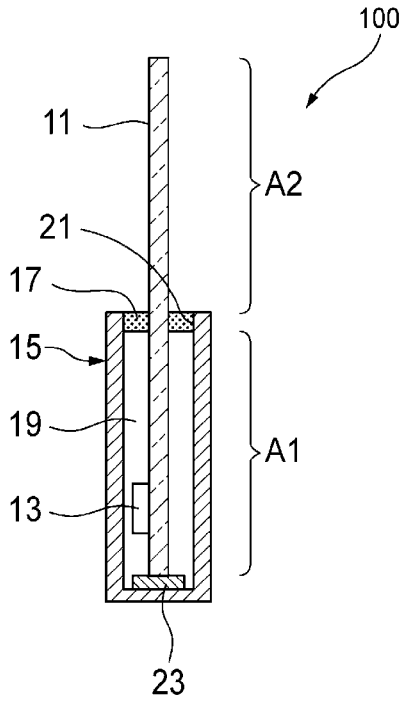
FIG. 3 is a sectional view of the vibration device taken along line in FIG. 2.

FIG. 1 is a schematic perspective view showing an external shape of a first example configuration of a vibration device according to the invention. FIG. 2 is a front view, as viewed from the direction indicated by arrow Va, of the vibration device shown in FIG. 1. FIG. 3 is a sectional view of the vibration device taken along line in FIG. 2.

As shown in FIG. 1, the vibration device 100 includes a glass diaphragm 11, an exciter(s) 13, an enclosing member 15, a shielding member 17, and a support member 23.

The glass diaphragm 11 generates sound being excited by vibrations generated by the exciter 13 (its detailed structure is described later). The glass diaphragm 11 may either be transparent (i.e., what is located behind it is seen) or opaque or selectively transparent (i.e., it serves as an optical filter such as a bandpass filter or has a surface treatment layer that provides a light diffusion surface) when it is seen from the direction indicated by arrow Va in FIG. 1. The glass diaphragm 11 may be either one substrate or a glass sheet composite including plural substrates. The glass diaphragm 11 is preferably made of a material having a large longitudinal wave acoustic velocity and can be, for example, a glass sheet, transparent ceramics, or a single crystal of sapphire, for example. Although the thus-configured glass diaphragm 11 has a rectangular external shape, the structure of the glass diaphragm 11 is not limited to it.

The exciter 13 is fixed to the glass diaphragm 11 and vibrates the glass diaphragm 11 according to an input electrical signal. Although not shown in any drawing, the exciter 13 includes, for example, a coil unit that is electrically connected to an external apparatus, a magnetic circuit unit, and an excitation unit which is connected to the coil unit or the magnetic circuit unit. When an electrical signal for sound generation is input from the external apparatus to the coil unit, vibration occurs in the coil unit or the magnetic circuit unit through interaction between the coil unit and the magnetic circuit unit. The vibration of the coil unit or the magnetic circuit unit is transmitted to the excitation unit, and then the vibration is transmitted from the excitation unit to the glass diaphragm 11.

At least one, preferably plural, exciters 13 are attached to the glass diaphragm 11. In this example configuration, two exciters 13 are attached to one major surface of the glass diaphragm 11 so as to be spaced from each other and arranged alongside one side of the outer periphery of the glass diaphragm 11.

The enclosing member 15 is box-shaped so as to enclose a portion, including the fixing positions of the exciters 13, of the glass diaphragm 11 and defines an internal space 19 that contains the exciters 13 and a part of the glass diaphragm 11. The other portion of the glass diaphragm 11 is exposed to outside the internal space 19 through an opening 21 of the internal space 19 formed by the enclosing member 15. That is, one end portion of the glass diaphragm 11 is exposed outside the internal space 19 through the opening 21 of the internal space 19. The "one end portion" of the glass diaphragm 11 means a far-side end portion of an end portion, closer to the fixing positions of the exciters 13, of the glass diaphragm 11 and an end portion, farther from the fixing positions of the exciters 13, of the glass diaphragm 11.

A sound absorbing member (not shown) such as a felt or a sponge may be attached to the inside or outside surfaces of the enclosing member 15. This increases the silencing effect in the internal space 19. The sound absorbing member is preferably attached to all or a part of the inside surfaces of the enclosing member 15. More specifically, whereas resonance-type sound absorbing members such as a porous sound absorbing member and a perforated board can be used as the sound absorbing member, use of the porous sound absorbing member is preferable from the viewpoint of a sound absorbable frequency range. The normal-incidence sound absorption ratio of the sound absorbing member at 1 kHz is preferably 0.25 or larger, even preferably 0.5 or larger and further preferably 0.75 or larger. The thickness of the sound absorbing member is preferably 0.5 mm or larger and 20 mm or less, even preferably 1 mm or larger and 10 mm or less. The attaching area of the sound absorbing member is preferably 25% or more and 50% or less of the area of the surfaces, defining the internal space 19, of the enclosing member 15.

The shielding member 17 for acoustic shielding between the opening 21 of the enclosing member 15 and the glass diaphragm 11 is provided in the opening 21. The shielding member 17 makes the internal space 19 a closed space and divides the glass diaphragm 11 into an excitation region A1 located inside the internal space 19 and a vibration region A2 located outside the internal space 19 (see FIG. 2).

The shielding member 17 may be general polymer material compositions that have a hydrocarbon composition, a silicone composition, or a fluorine-containing composition. However, the shielding member 17 is preferably made of a material that exhibits a storage modulus G' of $1.0\times10^2$ to $1.0\times10^{10}$ Pa, even preferably $1.0\times10^3$ to $1.0\times10^8$ Pa, when dynamic viscoelasticity of a sheet molded to have a thickness 1 mm is measured in a compression mode at 25° C. at a frequency 1 Hz. The above-used term "shielding" attained by the shielding member 17 means a state that it is in contact with the glass diaphragm 11 to such an extent as to allow the glass diaphragm 11 to make a slight movement of a micrometer order instead of fixing the glass diaphragm 11 completely. This prevents leakage of sound from the internal space 19.

In this configuration, a support member 23 for causing the enclosing member 15 to support the glass diaphragm 11 is provided between the bottom of the internal space 19 of the enclosing member 15 and a part of the excitation region A1 of the glass diaphragm 11. The support member 23 is preferably an elastic sheet made of a cushion material such as rubber, felt, or sponge.

Let a first direction Ax1 be a direction in which the glass diaphragm 11 projects outward from inside the internal space 19 and a second direction Ax2 be a direction that is perpendicular to the first direction Ax1 in the plate plane; then the maximum width Lw of the glass diaphragm 11 in the second direction Ax2 is preferably longer than or equal to a maximum width Lh in the first direction Ax1 (i.e., Lw≥Lh). In this case, the distance from the exciters 13 disposed in the excitation region A1 of the glass diaphragm 11 does not become too long at any point in the entire vibration region A2 and hence vibration generated by the exciters 13 travels to the vibration region A2 while being kept sufficiently strong.

According to the vibration device 100 having the above configuration, as shown in FIG. 3, the exciters 13 are attached to the glass diaphragm 11 and the glass diaphragm 11 is divided by the shielding member 17 into the excitation region A1 located in the internal space 19 inside the enclosing member 15 and the vibration region A2 located outside the internal space 19 and serves for acoustic radiation. Thus, sound that is generated in the excitation region A1 by vibrations of the exciters 13 is attenuated in the internal space 19. Furthermore, in the opening 21 of the internal space 19, acoustic shielding is established between the opening 21 of the internal space 19 and the glass diaphragm 11 by the shielding member 17, whereby leakage of sound generated from the excitation region A1 in the internal space 19 to outside the internal space 19 is prevented.

That is, when vibration of the exciters 13 provided in the excitation region A1 travels to the vibration region A2 and is radiated acoustically from the vibration region A2, a phenomenon that sound (noise) generated in the excitation region A1 is superimposed on the sound radiated from the vibration region A2 can be prevented. That is, the single, continuous glass diaphragm 11 is divided into the excitation region A1 and the vibration region A2 and the excitation region A1 is defined in the internal space 19 by the enclosing member 15 and the shielding member 17. In this manner, noise generated in the excitation region A1 is confined in the internal space 19 and prevented from leaking from the internal space 19, whereby a phenomenon that unnecessary noise generated in the excitation region A1 by vibrations of the exciters 13 is transmitted, as airborne sound, to a person who is to receive sound. As a result, reduction in directivity due to going-around of sound can be prevented. Furthermore, since vibration is radiated acoustically only from the vibration region A2 of the glass diaphragm 11 to the neighborhood, a sound pressure distribution of acoustic radiation can be made uniform.

Figure 4:
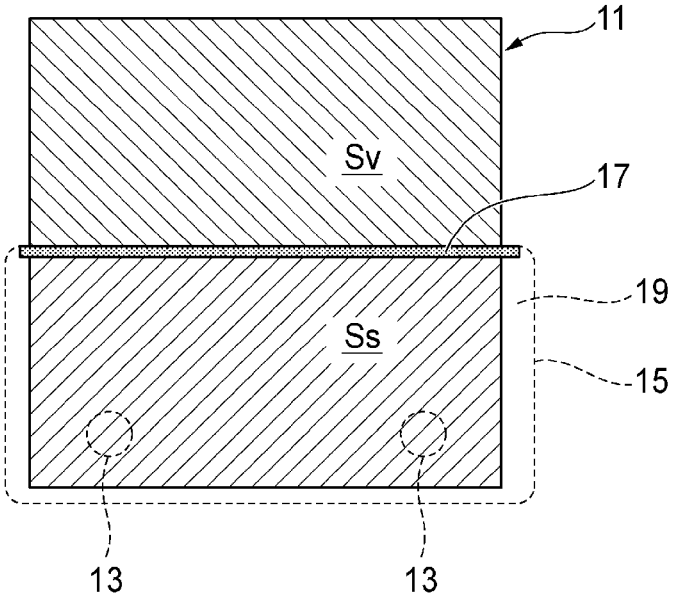
FIG. 4 is an explanatory diagram showing an excitation region and a vibration region of a glass diaphragm.

FIG. 4 is an explanatory diagram showing the excitation region A1 and the vibration region A2 of the glass diaphragm 11.

Let Ss and Sv represent the areas of the excitation region A1 and the vibration region A2 of the glass diaphragm 11, respectively. Then the area ratio Ss/Sv is preferably 0.01 or larger and 1.0 or less, even preferably 0.02 or larger and 0.5 or less and further preferably 0.05 or larger and 0.1 or less.

The efficiency of generation of a sound pressure lowers if the area of the excitation region A1 is too large relative to the area of the vibration region A2, and excitation driving cannot be performed efficiently if it is too small. Thus, by setting the area ratio in the above range, acoustic radiation from the vibration region A2 can be made at high efficiency according to vibrations of the exciters 13.

The total area of the glass diaphragm 11 is preferably 0.01 $m^2$ or larger, even preferably 0.1 $m^2$ or larger and further preferably 0.3 $m^2$ or larger. Setting the total area of the glass diaphragm 11 in this range makes it easier to attain the above-mentioned advantages of attaining a uniform sound pressure distribution and preventing lowering of directivity.

Second Example Configuration

Figure 5:
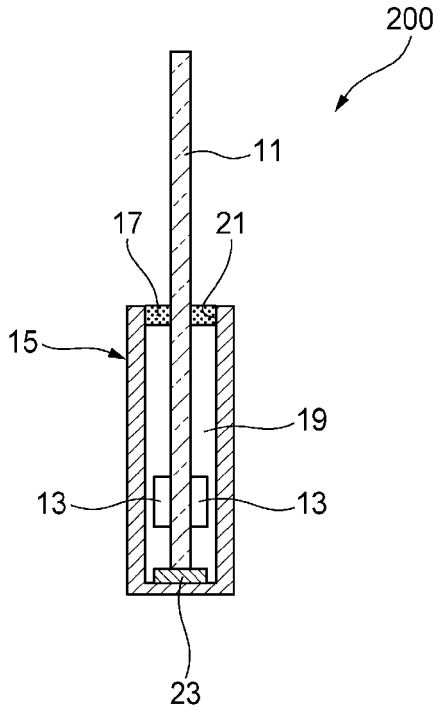
FIG. 5 is a sectional view of a vibration device having a second example configuration.

FIG. 5 is a sectional view of a vibration device having a second example configuration. FIG. 5 corresponds to a sectional view taken along line in FIG. 2.

In the vibration device 200 having this configuration, exciters 13 are disposed on the two respective surfaces of the glass diaphragm 11. The other parts of the configuration are the same as in the first example configuration.

According to this configuration, since the exciters 13 are disposed on one major surface and the other major surface of the glass diaphragm 11, the glass diaphragm 11 can be excited further strongly to produce a higher sound pressure. Furthermore, plural exciters 13 can be disposed with high spatial efficiency in a case that the area of an excitation region of the glass diaphragm 11 is restricted.

Third Example Configuration

Figure 6:
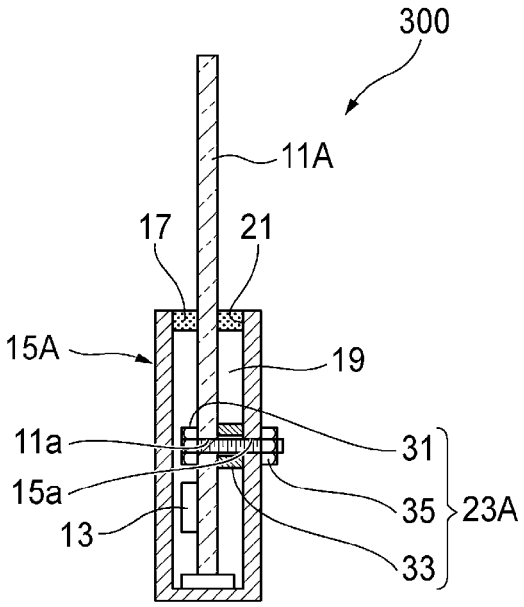
FIG. 6 is a sectional view of a vibration device having a third example configuration.

FIG. 6 is a sectional view of a vibration device having a third example configuration. FIG. 6 corresponds to a sectional view taken along line in FIG. 2.

In the vibration device 300 having this configuration, a glass diaphragm 11A is preferably fixed to an enclosing member 15A by a support member 23A which includes a bolt 31, a sleeve 33, and a nut 35.

A through-hole 11*a* into which the bolt 31 is to be inserted is formed through a glass diaphragm 11A and a through-hole 15*a* is also formed through one side wall of the enclosing member 15A. The bolt 31 is inserted into the through-hole 11*a* and a shaft portion of the bolt 31 is inserted into the through-hole 15*a* through the sleeve 33. A nut 35 is attached to a shaft portion, projecting from the through-hole 15*a*, of the bolt 31, whereby the glass diaphragm 11A and the enclosing member 15A are fastened to each other.

Since the bolt 31 is to be disposed in the internal space 19 of this enclosing member 15A in a fastened state, the enclosing member 15A may be shaped like a box by combining plural members so that bolt fastening is done in a disassembled state. The enclosing member 15A may be provided with a work window (not shown) near the bolt fastening position. Furthermore, a rubber bush may be interposed between the bolt and the nut for insulation of vibration between the glass diaphragm 11A and the enclosing member 15A.

In the vibration device 300 having this configuration, the glass diaphragm 11 can be fixed to the enclosing member 15A at a desired position by the fastening means such as the bolt 31 and the nut 35. As a result, the vibration device 300 can be disposed with a desired posture, that is, the degree of freedom is increased in the manner of its installation.

Fourth Example Configuration

Figure 7:
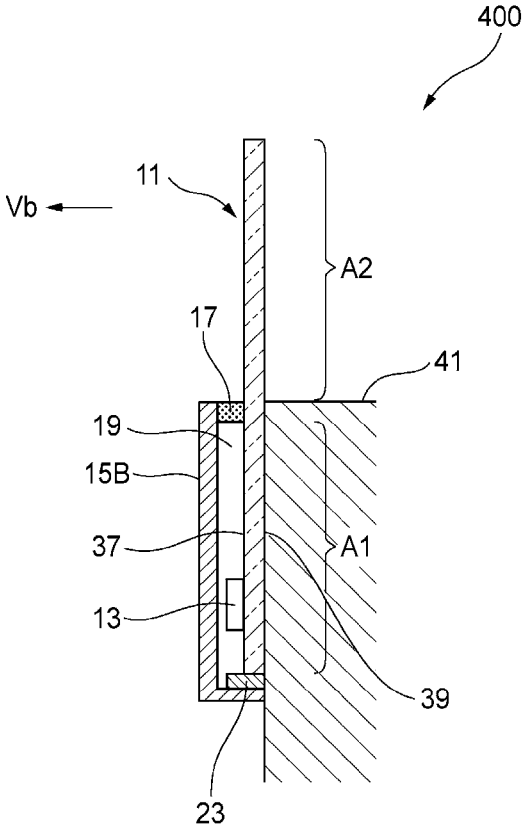
FIG. 7 is a sectional view of a vibration device having a fourth example configuration.

FIG. 7 is a sectional view of a vibration device having a fourth example configuration. FIG. 7 corresponds to a sectional view taken along line in FIG. 2.

In the vibration device 400 having this configuration, an internal space 19 is defined between the glass diaphragm 11 and an enclosing member 15B. That is, an internal space 19 is formed as a closed space by fixing the enclosing member 15B and the glass diaphragm 11 to each other via a shielding member 17 and a support member 23.

In this configuration, in the excitation region A1, sound (back surface sound) is generated from a surface 39 that is opposite to a surface 37 to which an exciter 13 is attached. In view of this, the portion, in the excitation region A1, of the glass diaphragm 11 is fixed to a member 41 other than the vibration device 400 to form a unified member so that back surface sound generated from the opposite surface 39 is not transmitted to a receiver who is located somewhere in the direction indicated by arrow Vb through the air as a medium. Example methods for fixing the vibration device 400 to the other member 41 a method using fastening members such as a bolt and a nut and a method using an adhesive. The glass diaphragm 11 is allowed to vibrate easily by making the other member 41 a member made of a low elasticity material or forming a vibration insulation layer on the surface 39.

In the vibration device 400 having this configuration, the structure of the enclosing member 15B can be simplified by defining the internal space 19 by enclosing the receiver-side surface 37 by the enclosing member 15B in the excitation region A1 of the glass diaphragm 11.

Fifth Example Configuration

Figure 8A:
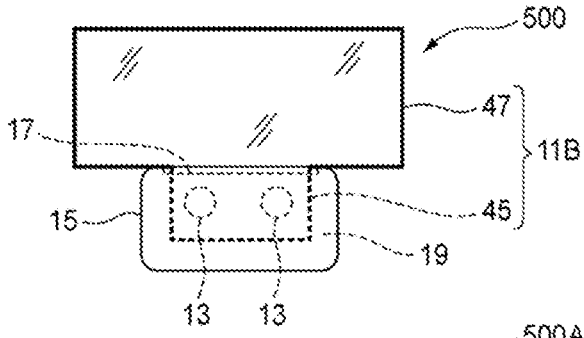
FIG. 8A is a schematic front view of a vibration device having a fifth example configuration and FIG. 8B, FIG. 8C, and FIG. 8D are schematic front views showing other example configurations.

FIG. 8A is a schematic front view of a vibration device having a fifth example configuration.

In the vibration device 500 having this configuration, a glass diaphragm 11B has a shape that is different from a rectangle that the glass diaphragms described above assume. The other parts of the configuration are the same as in the above-described first example configuration.

The glass diaphragm 11B has a rectangular first region 45 in which exciters 13 are attached and a rectangular second region 47 which is connected to the first region 45 and is larger in area than the first region 45. The first region 45 is connected to the second region 47 at the center of one side of the rectangular shape of the second region 47 and is disposed in an internal space 19 defined by the enclosing member 15. The first region 45 and the second region 47 of this configuration correspond to the excitation region A1 and the vibration region A2, respectively.

According to the vibration device 500 having this configuration, the area of the vibration region A2 can be made larger than that of the excitation region A1 without causing the outer periphery of the vibration region A2 to be spaced from the exciters 13 to a large extent.

Figure 8B:
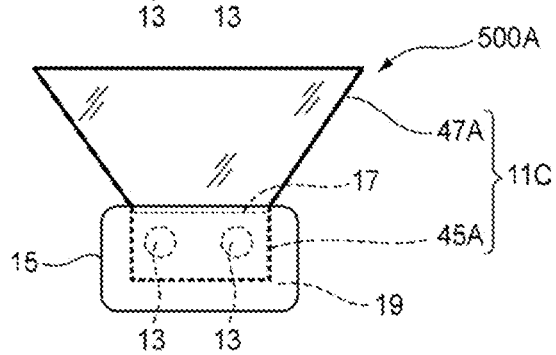

The second region 47 may be shaped like a trapezoid as shown in FIG. 8B rather than a rectangle. According to a vibration device 500A having this configuration, since the second region 47A is shaped like a trapezoid, interference with members around the vibration device 500A can be avoided more properly and the area of the vibration region A2 that is larger than the first region 45A can be secured more easily than in the case of the rectangular second region 47. Furthermore, the second region 47A may be given another desired shape such as an ellipse or a polygon.

Figure 8C:
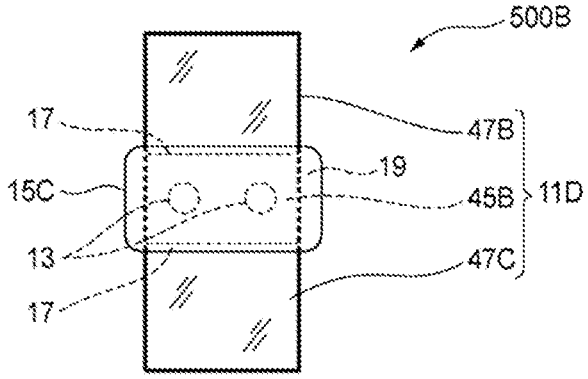

Instead of providing the enclosing member 15 adjacent to one end portion of the glass diaphragm, as shown in FIG. 8C it may be provided at the center in the longitudinal direction of a glass diaphragm 11D. In this case, a first region 45B which is enclosed by an enclosing member 15C located at the center of the glass diaphragm 11D serves as the excitation region A1 and second regions 47B and 47C which are disposed outside the enclosing member 15 serve as respective vibration regions A2. According to the vibration device 500B having this configuration, vibrations generated by the exciters 13 travel to the two second regions 47B and 47C (vibration regions A2) and acoustic radiations can be emitted from them simultaneously. This allows acoustic radiation to have a sound pressure distribution that is higher in uniformity while preventing reduction in directivity due to going-around of sound.

Figure 8D:
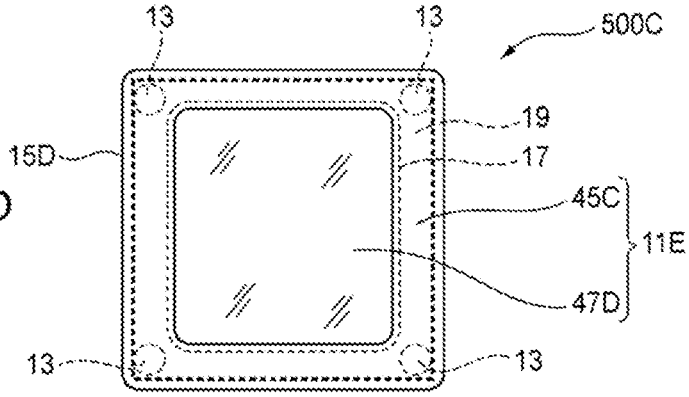

Furthermore, as shown in FIG. 8D, an enclosing member 15D may be disposed along the outer periphery of a glass diaphragm 11E so that an outer peripheral portion of the glass diaphragm 11E is made a first region 45C to serve as an excitation region A1 and a central portion of the glass diaphragm 11E is made a second region 47D to serve as a vibration region A2.

According to a vibration device 500C having this configuration, vibrations generated by exciters 13 disposed in the outer peripheral portion of the glass diaphragm 11E travel to the second region 47D and emitted from the second region 47. Furthermore, no part of noise generated in the first region 45C leaks from the internal space 19 which is defined by the enclosing member 15D.

Sixth Example Configuration

Figure 9A:
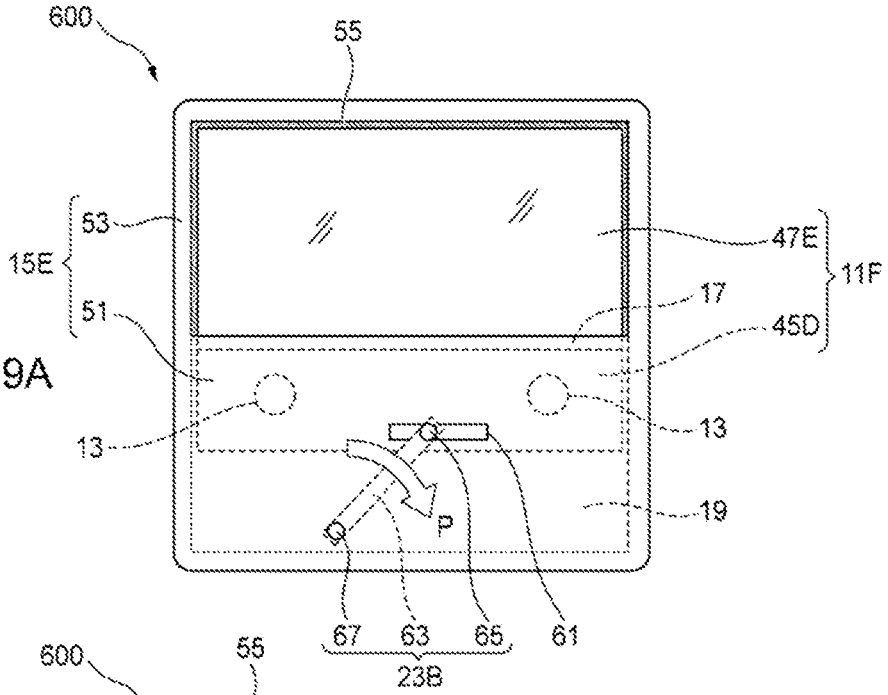
FIG. 9A and FIG. 9B are schematic front views of a vibration device having a sixth example configuration.
Figure 9B:
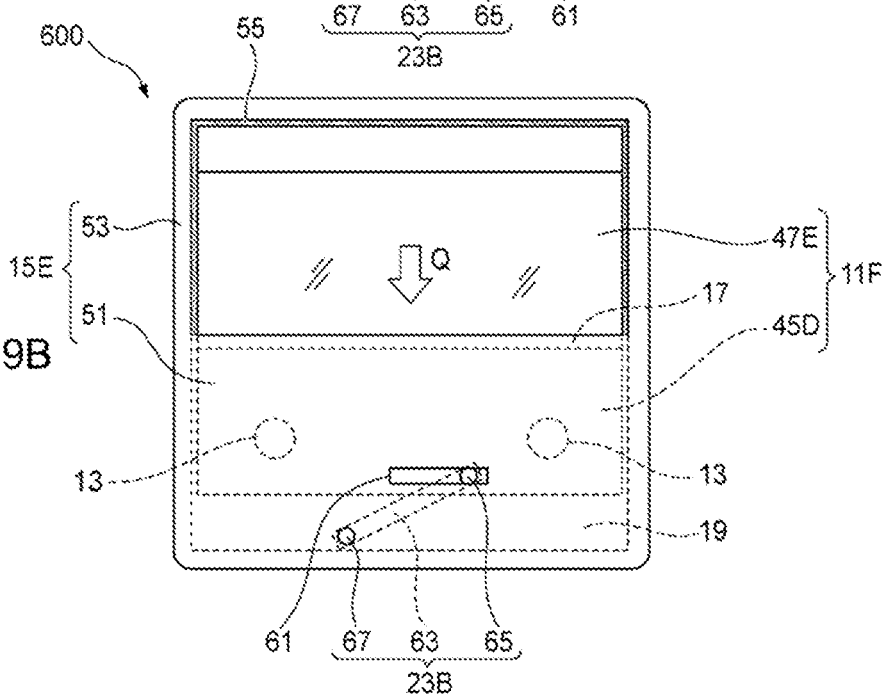

FIG. 9A and FIG. 9B are schematic front views of a vibration device having a sixth example configuration.

In the vibration device 600 having this configuration, a glass diaphragm 11F is provided so as to be movable relative to an enclosing member 15E.

The enclosing member 15E includes a body portion 51 which defines an internal space 19 and a frame portion 53 which is disposed along the outer periphery of the glass diaphragm 11F. A support member 23B supports the glass diaphragm 11F so that the glass diaphragm 11F and the enclosing member 15E can be moved relative to each other.

As shown in FIG. 9A, the glass diaphragm 11F includes a first region 45D which is disposed inside the internal space 19 and to which exciters 13 are attached and a second region 47E which is located outside the internal space 19. The first region 45D and the second region 47E are divided by a shielding member 17.

The frame portion 53 of the enclosing member 15E is disposed along the outer periphery of the second region 47E of the glass diaphragm 11F. The frame portion 53 is a frame body that extends along the outer periphery of the second region 47E. If necessary, the frame portion 53 is provided with a cushion member 55 between the frame portion 53 and the glass diaphragm 11F.

A guide hole 61 which penetrates through the glass diaphragm 11F in its thickness direction is formed in the first region 45D. A follower 65 which is supported by one end portion of a swing arm 63 is inserted in the guide hole 61 slidably. The other end portion of the swing arm 63 is supported swingably by the enclosing member 15E via a rotary support shaft 67. The rotary support shaft 67 is connected to a drive unit such as a motor (not shown), and is driven rotationally by the drive unit. When the rotary support shaft 67 is rotated, the swing arm 63 is swung on the rotary support shaft 56.

In the vibration device 600 having this configuration, when the swing arm 63 is swung being driven by the drive unit in a direction indicated by arrow P in FIG. 9A, the follower 65 is moved along the guide hole 61. As a result, the glass diaphragm 11F is moved in a direction indicated by arrow Q in FIG. 9B. In this manner, the areas of the excitation region A1 and the vibration region A2 can be varied.

The vibration device of the above first to sixth example configurations can be used, for example, as a member of an electronic device, examples of which are a full-range speaker, a speaker for reproduction of bass sound in a 15 Hz to 200 Hz range, a speaker for reproduction of treble sound in a 10 kHz to 100 kHz range, a large-size speaker having a diaphragm area of 0.2 $m^2$ or larger, a planar speaker, a cylindrical speaker, a transparent speaker, a cover glass for a mobile device that functions as a speaker, a cover glass for a TV display, a screen film, a display that generates a video signal and an audio signal from the same surface, a speaker for a wearable display, an electric bulletin board, and illumination equipment. The speaker can be used for music, alarm sound, etc.

The vibration device can also be used as a microphone diaphragm or a vibration sensor by installing a vibration detection element such as an acceleration sensor.

The vibration device can be used as an interior vibration member of a transport machine such as a vehicle or a vehicular or onboard speaker. For example, the vibration device can be used as each of various kinds of interior panels functioning as a speaker, such as a side-view mirror, a sunvisor, an instrument panel, a dashboard, a ceiling, and a door. Each of these panels can also be used so as to function as a microphone or a diaphragm for active noise control.

For example, the vibration device can be used as an opening member used in, for example, a construction or transport machine. In this case, it is possible to add such a function as IR blocking, UV blocking, or coloration to the diaphragm.

More specifically, the vibration device can be applied to each of a speaker installed inside or outside a vehicle and a vehicular windshield, side window glass, rear window glass, and roof glass having a sound insulation function. The vibration device can also be used as each of a vehicular window glass, a structural member, and a decorative plate that are improved in water repellency, snow accretion resistance, ice accretion resistance, or an antifouling property by sound wave vibration. More specifically, the vibration device can be used as each of a lens and a sensor and a cover glass thereof in addition to a vehicular window glass, mirror, and a flat or curved plate member to be mounted in the car.

Members for construction include a window glass, a door glass, and a roof glass, an interior member, an exterior member, a structural member, an outer wall, and a cover glass for a solar battery each of which can function as a diaphragm or a vibration detection device. Furthermore, the vibration device can be used as a partition or mirror stand in banks, hospitals, hotels, restaurants, offices, etc. Each of them may be used as a sound reflection (reverberation) board. Furthermore, water repellency, snow accretion resistance, and the antifouling property (mentioned above) can be enhanced by sound wave vibration.

The above-described enclosing member and the glass diaphragm itself can be used to form the internal space 19 of each vibration device. In addition, for example, a body and a door panel of a vehicle and a sash (example construction member) can also be used.

As for each exciter, the excitation power can be increased by suppressing vibration of an exciter body by fixing the back side of each exciter to a back board, a frame, or the like.

Furthermore, the sound insulation can be increased by decreasing the sound propagation speed by lowering the internal pressure of the internal space 19 or charging it with He gas. It is also possible to suppress transmission of sound through the enclosing member or resonance in the internal space by disposing a sound insulation material or a sound absorbing member in the internal space.

<Specific Example Configuration of Glass Diaphragm>

As described later in detail, the glass diaphragm which is a member of the vibration device preferably has a loss coefficient at 25° C. of $1\times10^{-3}$ or larger and a longitudinal wave acoustic velocity in the thickness direction of $4.0\times10^{3}$ m/s or larger. The expression "the loss coefficient is large" means that the vibration attenuation capacity is high.

As for the loss coefficient, a value calculated by a half-width method is used. Denoting f as the resonant frequency of a material and W as a frequency width at a point decreased by −3 dB from the peak value of the amplitude h (namely, the point of (maximum amplitude) −3 [dB]), the loss coefficient is defined as a value represented by {W/f}.

In order to prevent the resonance, the loss coefficient may be increased, namely, this means that the frequency width W becomes relatively large with respect to the amplitude h and the peak becomes broader.

The loss coefficient is specific to a material or the like. For example, in the case of a simple glass sheet, the loss coefficient varies depending on its composition, relative density, etc. A loss coefficient can be measured by a dynamic elasticity modulus test method such as a resonance method.

The longitudinal wave acoustic velocity means a propagation speed of longitudinal waves through a diaphragm. A longitudinal wave acoustic velocity and a Young's modulus can be measured by an ultrasonic pulse method prescribed in JIS-R1602-1995.

As for a specific structure for obtaining a large loss coefficient and a high longitudinal wave acoustic velocity, it is preferable that the glass diaphragm include two or more glass sheets and also include a prescribed fluid layer between at least a pair of glass sheets among the glass sheets.

The glass sheet means an inorganic glass or organic glass. Examples of the organic glass are PMMA-based resins, PC-based resins, PS-based resins, PET-based resins, and cellulose-based resins, which are common transparent resins.

Where two or more glass sheets are used, it is possible to employ an inorganic glass sheet or organic glass sheet mentioned above as one glass sheet and any of various sheets such as a resin sheet made of a resin other than organic glass, a metal sheet made of aluminum or the like, and a ceramic sheet made of ceramic can be used in place of the other glass sheet. From the viewpoints of design performance, workability, and weight, use of organic glass, a resin material, a composite material, a fiber material, a metal material, or the like is preferable. From the viewpoint of the vibration property, use of inorganic glass, a composite material or fiber material that is high in stiffness, a metal material, or a ceramic material is preferable.

Among resin materials, use of resin materials that can be molded into a flat plate shape or a curved plate shape is preferable. Preferable composite materials and fiber materials are a resin composite material or carbon composite fiber containing a high-hardness filler, Kevlar fiber, etc. Preferable metal materials are aluminum, magnesium, copper, silver, gold, iron, titanium, SUS, etc. Other alloy materials etc. may also be used if necessary.

Even preferable ceramic materials are ceramic or single crystal materials such as $Al_2O_3$, SiC, $Si_3N_4$, AlN, mullite, zirconia, yttria, and YAG. Use of ceramic materials having transparency is particularly preferable.

(Fluid Layer)

A large loss coefficient of the glass diaphragm can be realized by providing a fluid layer containing liquid between at least a pair of glass sheets. In particular, an even larger loss coefficient can be obtained by setting the viscosity and the surface tension of the fluid layer in preferable ranges. This is considered because of the fact that the pair of glass sheets are not fixed to each other and each glass sheet continues to exhibit its vibration characteristic unlike in a case that a pair of glass sheets are provided via an adhesive layer. In this specification, the term "fluid" means anything that has fluidity and that includes a liquid, and the fluid includes a liquid, semisolid, a mixture of a solid powder and a liquid, a solid gel (jelly-like substance) impregnated with liquid, and the like.

The viscosity coefficient at 25° C. of the fluid layer is preferably $1\times10^{-4}$ to $1\times10^{3}$ Pa·s, and the surface tension of the fluid layer at 25° C. is preferably 15 to 80 mN/m. If the viscosity is too low, vibration less tends to transmitted. If the viscosity is too high, the pair of glass sheets located on the two respective sides of the fluid layer are fixed to each other and come to exhibit vibratory behavior like a single glass sheet does, and resonance vibration less tends to attenuate. If the surface tension is too weak, the adhesion between the pair of glass sheets becomes so weak that vibration less tends to transmitted. If the surface tension is too large, the pair of glass sheets located on the two respective sides of the fluid layer are prone to be fixed to each other and come to exhibit vibratory behavior like a single glass sheet does, and resonance vibration less tends to attenuate.

The viscosity coefficient at 25° C. of the fluid layer is more preferably $1\times10^{-3}$ Pa·s or larger, further preferably $1\times10^{-2}$ Pa·s or larger. The viscosity coefficient at 25° C. of the fluid layer is more preferably $1\times10^{2}$ Pa·s or less, further preferably 1×10 Pa·s or less. The surface tension of the fluid layer at 25° C. is preferably 20 mN/m or larger, further preferably 30 mN/m or larger.

A viscosity coefficient of the fluid layer can be measured by a rotary viscosity meter, for example. Surface tension of the fluid layer can be measured by a ring method, for example.

If the fluid layer is too high in vapor pressure, it may evaporate to make the glass vibrator non-functional. Thus, the vapor pressure of the fluid layer at 25° C. and 1 atm is preferably $1\times10^{4}$ Pa or less, further preferably $5\times10^{3}$ Pa or less and still further preferably $1\times10^{3}$ Pa or less. In the case where the vapor pressure is high, the fluid layer may be, for example, sealed to prevent its evaporation. In this case, it is ensured to prevent a sealing member from obstructing vibration of the glass vibrator.

From the viewpoints of maintenance of high stiffness and transmission of vibration, it is preferable that the fluid layer be as thin as possible. More specifically, in the case where the total thickness of the pair of glass sheets is 1 mm or less, the thickness of the fluid layer is preferably 1/10 or less, more preferably 1/20 or less, still more preferably 1/30 or less, yet still more preferably 1/50 or less, even still more preferably 1/70 or less, even yet still more preferably 1/100 or less, of the total thickness of the two glass sheets. In the case where the total thickness of the pair of glass sheets exceeds 1 mm, the thickness of the fluid layer is preferably 100 μm or less, more preferably 50 μm or less, still more preferably 30 μm or less, yet still more preferably 20 μm or less, even still more preferably 15 μm or less, even yet still more preferably 10 μm or less. As for the lower limit, the thickness of the fluid layer is preferably 0.01 μm or greater from the viewpoints of the ease of film formation and durability.

It is preferable that the fluid layer be chemically stable and not react with the pair of glass sheets located on the two respective sides of it. The expression "chemically stable" means that, for example, the fluid layer is less prone to be changed in quality (degraded) or not prone to solidify, vaporize, decompose, change in color, chemically react with glass, or undergo a like change at least in a temperature range of −20° C. to 70° C.

Examples of ingredients usable as the liquid layer include water, oils, organic solvents, liquid polymers, ionic liquids, and mixtures of two or more of these. More specific examples are propylene glycol, dipropylene glycol, tripropylene glycol, straight silicone oil (dimethyl silicone oil, methylphenyl silicone oil, and methyl hydrogen silicone oil), modified silicone oil, an acrylic acid-based polymer, liquid butadiene, a glycerin paste, a fluorine-based solvent, a fluorine-based resin, acetone, ethanol, xylene, toluene, water, mineral oil, and a mixture thereof. It is preferable to contain, among these examples, at least one substance selected from the group consisting of propylene glycol, dimethyl silicone oil, methylphenyl silicone oil, methyl hydrogen silicone oil, and modified silicone oil. It is more preferable that the liquid layer contain propylene glycol or silicone oil as a main component.

In addition to the above substances, powder-dispersed slurry can be used as the fluid layer. Whereas from the viewpoint of increasing the loss coefficient, the fluid layer is preferably a uniform fluid, the above slurry is effective in the case of giving the glass vibrator a design feature or functionality such as coloration or fluorescence. The powder content in the fluid layer is preferably 0 to 10 volume %, even preferably 0 to 5 volume %. From the viewpoint of preventing sedimentation, the particle diameter of the powder is preferably 10 nm to 1 μm, even preferably 0.5 μm or less.

From the viewpoint of adding a design feature or functionality, the fluid layer may contain a fluorescent material. In this case, the fluid layer may be a slurry-like fluid layer in which a fluorescent material is dispersed in the form of a powder or a uniform fluid layer in which a fluorescent material is mixed in the form of a liquid. This makes it possible to give the glass vibrator optical functions such as light absorption and emission.

Figure 10:
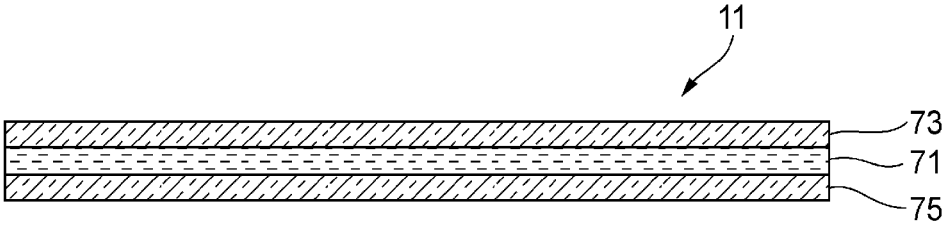
FIG. 10 is a sectional view of one specific example of the glass diaphragm.

FIG. 10 is a sectional view showing a specific example of the glass diaphragm.

In the glass diaphragm 11, it is preferable that at least a pair of glass sheets 73 and 75 be provided in such a manner that the fluid layer 71 is disposed between the pair of glass sheets 73 and 75 from both sides. The fluid layer 71 prevents the glass sheet 75 from resonating with the glass sheet 73 or attenuates resonance vibration of the glass sheet 75, when resonance occurs in the glass sheet 73. The presence of the fluid layer 71 can make the loss coefficient of the glass diaphragm 11 larger than in the case that the glass sheet is provided solely.

It is preferable that the loss coefficient of the glass diaphragm 11 be as large as possible because vibration is attenuated more. The loss coefficient at 25° C. of the glass diaphragm 11 is preferably $1\times10^{-3}$ or larger, even preferably $2\times10^{-3}$ or larger and further preferably $5\times10^{-3}$ or larger. Since the reproducibility of radio-frequency sound of a glass diaphragm is increased as the acoustic velocity increases, the longitudinal wave acoustic velocity of the glass diaphragm 11 in the thickness direction be $4.0\times10^{3}$ m/s or larger, even preferably $4.5\times10^{3}$ m/s or larger and further preferably $5.0\times10^{3}$ m/s or larger. Although there are no particular limitations on the upper limit, the longitudinal wave acoustic velocity of the glass diaphragm in the thickness direction is preferably $7.0\times10^{3}$ m/s or less.

The glass diaphragm 11 can be used as a light-transmissive member if its straight transmittance is high. Thus, the visible light transmittance as measured according to JIS-R3106-1998 is preferably 60% or higher, even preferably 65% or higher and further preferably 70% or higher. Example uses as a light-transmissive member are a transparent speaker, a transparent microphone, and an opening member for construction or vehicles.

It is also useful to make refraction index matching to increase the transmittance of the glass diaphragm 11. That is, it is preferable that the refractive indices of the glass sheet and the refractive index of the fluid layer constituting the glass diaphragm 11 be as close to each other as possible because the reflection and interference at the interfaces can be reduced. In particular, the differences between the refractive index of the fluid layer and the refractive indices of the pair of glass sheets that are in contact with the fluid layer are preferably 0.2 or less, even preferably 0.1 or less and further preferably 0.01 or less.

(Glass Sheet)

It is possible to color at least one of the fluid layers 71 and at least one of the glass sheets that constitute the glass diaphragm 11. This is useful when it is desired to give the glass diaphragm 11 a design feature or functionality such as IR blocking, UV blocking, or a privacy glass function.

It is preferable that, of the pair of glass sheets including glass sheets 73 and 75, one glass sheet 73 and the other glass sheet 75 have different peak top value of resonance frequency. It is even preferable that the resonance frequency ranges do not overlap with each other. However, even if the resonance frequency ranges of the glass sheets 73 and 75 overlap with each other or their peak top values are the same, because of the presence of the fluid layer 71, resonance of one glass sheet 73 is not synchronized with vibration of the other glass sheet 75. As a result, resonance is canceled out to some extent, whereby a larger loss coefficient is obtained than in the case of only the glass sheets.

That is, it is preferable that the following Formula 1 be satisfied, where Qa and wa are the resonance frequency (peak top) and the half width of resonance amplitude of the glass sheet 73, respectively, and Qb and wb are the resonance frequency (peak top) and the half width of resonance amplitude of the glass sheet 75, respectively:

$$(wa+wb)/4<|Qa-Qb|. \quad \text{[Formula 1]}$$

The difference between the resonance frequencies of the glass sheets 73 and 75 (|Qa−Qb|) increases to provide a large loss coefficient as the value of the left side of Formula 1 becomes larger, which is preferable.

Thus, it is even preferable that the following Formula 2 be satisfied and it is further preferable that the following Formula 3 be satisfied:

$$(wa+wb)/2<|Qa-Qb| \quad \text{[Formula 2]}$$

$$(wa+wb)/1<|Qa-Qb|. \quad \text{[Formula 3]}$$

A resonance frequency (peak top) and a half width of resonance amplitude of each glass sheet can be measured by the same method as a loss coefficient of the glass vibrator.

The mass difference between the glass sheets 73 and 75 is preferably as small as possible, and it is even preferable that they have no mass difference. This is because where the glass sheets have a mass difference, resonance of a lighter glass sheet can be suppressed by a heavier glass sheet but it is difficult to suppress resonance of the heavier glass sheet by the lighter glass sheet. That is, where the mass ratio deviates from 1 to some extent, in principle resonance vibration of one and that of the other cannot cancel out each other because of a difference in inertial force.

The mass difference between the glass sheets 73 and 75 that is given by (glass sheet 73)/(glass sheet 75) is preferably 0.8 to 1.25 (8/10 to 10/8), even preferably 0.9 to 1.1 (9/10 to 10/9) and further preferably 1.0 (10/10).

As the glass sheets 73 and 75 become thinner, they can come close to each other more easily via the fluid layer and can be vibrated with smaller energy. Thus, for use as a diaphragm of a speaker or the like, it is preferable that the glass sheets 73 and 75 be as thin as possible. More specifically, the thickness of each of the glass sheets 73 and 75 is preferably 15 mm or less, more preferably 10 mm or less, still more preferably 5 mm or less, yet still more preferably 3 mm or less, even still more preferably 1.5 mm or less, even yet still more preferably 0.8 mm or less. On the other hand, if the glass sheets 73 and 75 are too thin, influences of surface defects of the glass sheets 73 and 75 become so remarkable that they become prone to fracture or become difficult to treat for strengthening. Therefore, the thickness of each of the glass sheets 73 and 75 is preferably 0.01 mm or larger, further preferably 0.05 mm or larger.

In uses as an opening member for construction or vehicles in which generation of abnormal sound due to a resonance phenomenon should be suppressed, the thickness of each of the glass sheets 73 and 75 is preferably 0.5 to 15 mm, even preferably 0.8 to 10 mm and further preferably 1.0 to 8 mm.

It is preferable for use as a diaphragm that at least one of the glass sheets 73 and 75 have a large loss coefficient because the glass diaphragm 11 exhibits a high degree of attenuation of vibration. More specifically, the loss coefficient at 25° C. of at least one of the glass sheets 73 and 75 is preferably $1\times10^{-4}$ or larger, even preferably $3\times10^{-4}$ or larger and further preferably $5\times10^{-4}$ or larger. Although there are no particular limitations on the upper limit, the loss coefficient at 25° C. is preferably $5\times10^{-3}$ or less from the viewpoints of the productivity and the production cost. Furthermore, the loss coefficients of both of the glass sheets 73 and 75 is preferably in the above range. A loss coefficient of a glass sheet can be measured by the same method as a loss coefficient of the glass diaphragm 11.

It is preferable for use as a diaphragm that at least one of the glass sheets 73 and 75 is high in the longitudinal wave acoustic velocity in the thickness direction because the reproducibility of sound in a radio frequency range is increased. More specifically, the longitudinal wave acoustic velocity of the glass sheet is preferably $5.0\times10^3$ m/s or larger, even preferably $5.5\times10^3$ m/s or larger and further preferably $6.0\times10^3$ m/s or larger. Although there are no particular limitations on the upper limit, the longitudinal wave acoustic velocity is preferably $7.0\times10^3$ m/s or less from the viewpoints of the productivity and the material cost of the glass sheets. It is more preferable that both the glass sheets 73 and 75 satisfy the acoustic velocity value mentioned above. An acoustic velocity of each glass sheet can be measured by the same method as a longitudinal wave acoustic velocity of the glass vibrator.

Although there are no particular limitations on the composition of the glass sheets 73 and 75, the composition is, as represented by mass % based on oxides, preferably in the following component ranges: $SiO_2$: 40-80 mass %, $Al_2O_3$: 0-35 mass %, $B_2O_3$: 0-15 mass %, MgO: 0-20 mass %, CaO: 0-20 mass %, SrO: 0-20 mass %, BaO: 0-20 mass %, $Li_2O$: 0-20 mass %, $Na_2O$: 0-25%, $K_2O$: 0-20 mass %, $TiO_2$: 0-10 mass %, and $ZrO_2$: 0-10 mass %. And the total content of the above substances should account for 95 mass % or more of the entire glass.

Even preferable component ranges of the composition of the glass sheets 73 and 75 (as represented by mass % based on oxides) is as follows: $SiO_2$: 55-75 mass %, $Al_2O_3$: 0-25 mass %, $B_2O_3$: 0-12 mass %, MgO: 0-20 mass %, CaO: 0-20 mass %, SrO: 0-20 mass %, BaO: 0-20 mass %, $Li_2O$: 0-20 mass %, $Na_2O$: 0-25%, $K_2O$: 0-15 mass %, $TiO_2$: 0-5 mass %, and $ZrO_2$: 0-5 mass %. And the total content of the above substances should account for 95 mass % or more of the entire glass.

Each of the glass sheets 73 and 75 can be vibrated with smaller energy as its specific gravity decreases. More specifically, the specific gravity of each of the glass sheets 73 and 75 is preferably 2.8 or less, even preferably 2.6 or less and further preferably 2.5 or less. Although there are no particular limitations on the lower limit, the specific gravity is preferably 2.2 or larger. The stiffness of each of the glass sheets 73 and 75 increases as the specific modulus of elasticity obtained by dividing the Young's modulus by the density of the glass sheets 73 and 75 becomes larger. More specifically, the specific modulus of elasticity of each of the glass sheets 73 and 75 is preferably $2.5\times10^7$ $m^2/s^2$ or larger, even preferably $2.8\times10^7$ $m^2/s^2$ or larger and further preferably $3.0\times10^7$ $m^2/s^2$ or larger. Although there are no particular limitations on the upper limit, the specific modulus of elasticity is preferably $4.0\times10^7$ $m^2/s^2$ or less.

Figure 11:
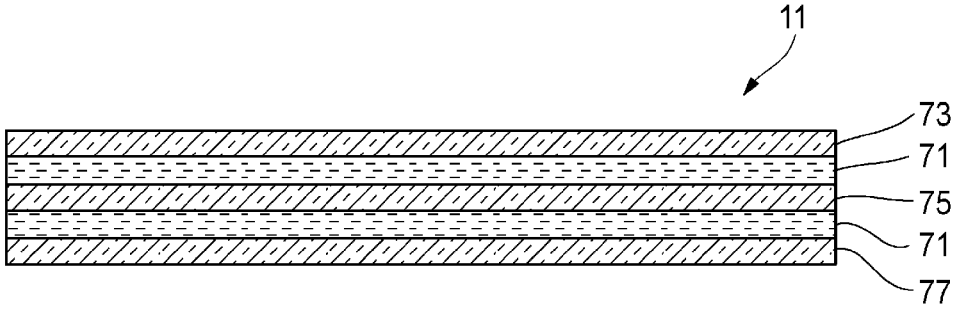
FIG. 11 is a sectional view of another example of the glass vibrator.

Whereas the number of glass sheets constituting the glass diaphragm 11 is two or more, three or more glass sheets may be used as shown in FIG. 11. The glass sheets 73 and 75 in the case of two glass sheets or the glass sheets 73, 75 and 77 in the case of three or more glass sheets may be such that all of them have different compositions, all of them have the same composition, or they are a combination of glass sheets having the same composition and a glass sheet(s) having another composition. In particular, it is preferable from the viewpoint of attenuation of vibration to use two or more kinds of glass sheets having different compositions. Likewise, in mass or thickness, all of the glass sheets may be either the same or different from each other or part of the glass sheets may be different from the other ones. It is preferable in terms of attenuation of vibration that all of the constituent glass sheets have the same mass.

A physically strengthened glass sheet or a chemically strengthened glass sheet can be used as at least one of the glass sheets constituting the glass diaphragm 11. This is useful in preventing destruction of the glass diaphragm 11 which is a glass sheet composite. To increase the strength of the glass diaphragm 11, it is preferable that the glass sheet that provides its outermost surface be a physically strengthened glass sheet or a chemically strengthened glass sheet. It is even preferable that all the constituent glass sheets be physically strengthened glass sheets or chemically strengthened glass sheets.

Using crystallized glass or phase-separated glass as the glass sheet is useful in increasing the longitudinal wave acoustic velocity or strength. In particular, when it is desired to increase the strength of the glass diaphragm 11 which is a glass sheet composite, it is preferable that the glass sheet that provides its outermost surface be made of crystallized glass or phase-separated glass.

Figure 12A:
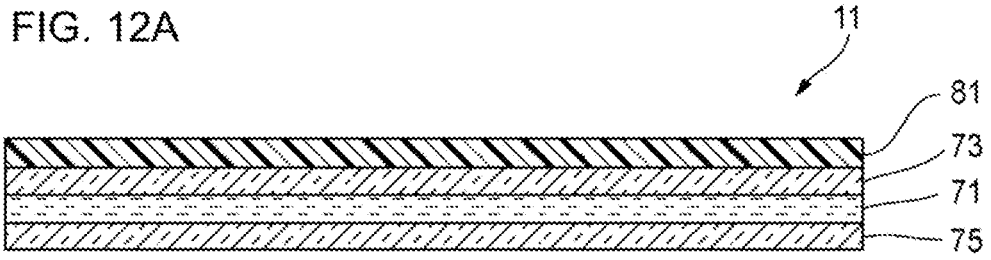
FIG. 12A and FIG. 12B are sectional views of other examples of the glass vibrator.
Figure 12B:
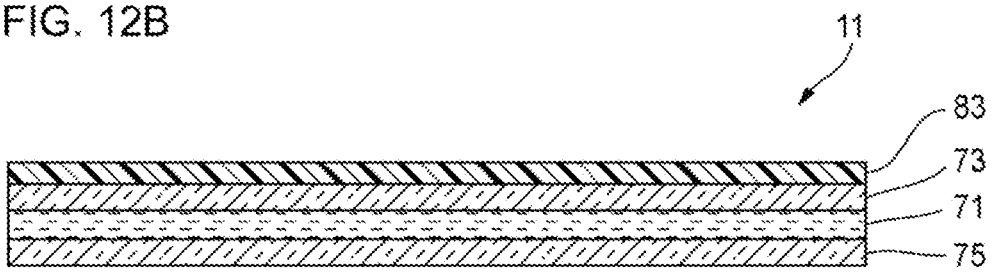

In the glass diaphragm 11, a coating layer 81 shown in FIG. 12A or a film 83 shown in FIG. 12B may be formed on at least one the outermost surface of the glass sheet composite within the confines that the advantages of the invention are not lowered. The formation of the coating layer 81 and the sticking of the film 83 are suitable to, for example, prevent dispersal and scratches. The thickness of the coating layer 81 or the film 83 is preferably ⅕ or less of that the thickness of the surface glass sheet. The coating layer 81 and the film 83 may be known ones. Examples of the coating layer 81 include a water-repellent coating, a hydrophilic coating, a water-slidable coating, an oil-repellent coating, an antireflection coating, and a thermal barrier coating. Examples of the film 83 include a glass scattering prevention film, a color film, a UV blocking film, IR blocking film, a heat-shielding film, and an EM-shielding film.

A sound absorbing member, not shown in the figures, may be attached to all or a part of at least one surface of the excitation area A1 of the glass diaphragm 11. In this case, the generation of standing waves is suppressed, thereby reducing the sound pressure level in the internal space 19. As the sound absorbing member, a porous sound absorbing member made of sponge, fiber, etc. or a resonant sound absorbing member made of perforated board, etc. can be used. It is preferable to use a porous sound absorbing member from the viewpoint of the frequency band that can be sound absorbed and the weight reduction of the diaphragm.

The sound absorbing member may be attached to at least one surface of the excitation region A1 of the glass diaphragm 11, and preferably attached to both surfaces of the excitation region A1 of the glass diaphragm 11. When attaching the sound absorbing member to the surface, where the exciter 13 is provided, of the glass diaphragm 11, it is preferable to cover the entire exciter 13 with the sound absorbing member.

The area of the sound absorbing member when attaching to the glass diaphragm 11 is preferably 50% or more, more preferably 75% or more, of the area of at least one surface of the excitation region A1. The sound absorbing member is preferably 0.25 or larger in normal-incidence sound absorption ratio at 1 Hz in the excitation region A1, more preferably 0.5 or larger, further preferably 0.75 or larger. The thickness of the sound absorbing member is preferably 0.5 mm or larger and 30 mm or less, preferably 5 mm or larger and 20 mm or less.

Figure 13:
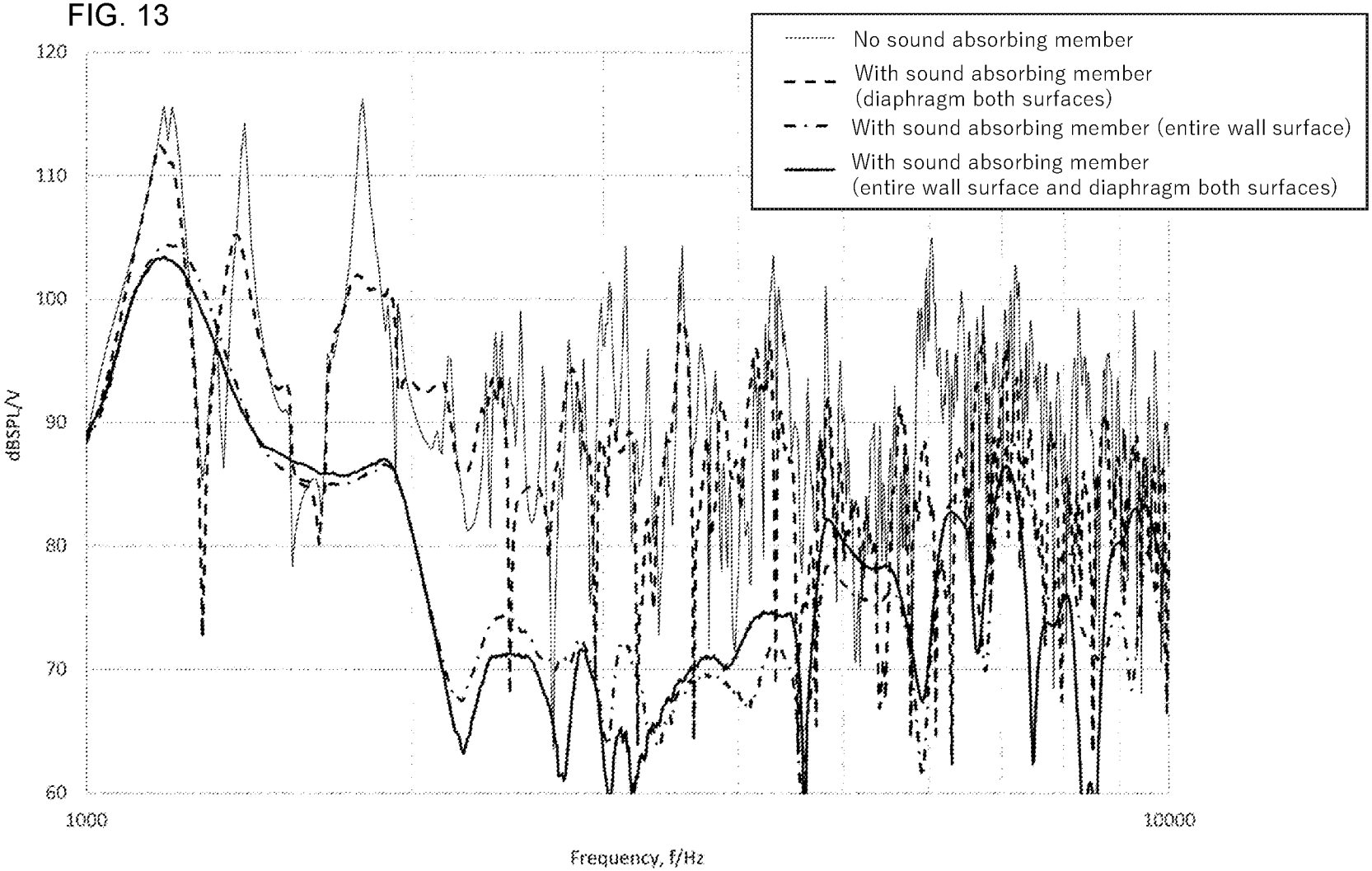
FIG. 13 is a graph showing sound frequency vs. sound pressure level characteristics in a case that no sound absorbing member is used, a case that a sound absorbing member is attached to the glass diaphragm, a case that a sound absorbing member is attached to the inner wall surfaces of the enclosing member, and a case that a sound absorbing member is attached to the glass diaphragm and the inner wall surfaces of the enclosing member.

FIG. 13 shows the sound pressure level inside the container when a glass diaphragm of size 100 mm×100 mm×1.0 mm was installed to simulate the excitation region A1 in the center of the glass diaphragm, and an exciter with an impedance of 4Ω was installed and vibrated with a sinusoidal signal of output voltage 1V. In the case where no sound absorbing member is attached to the inner wall surface of the container and the diaphragm, standing waves are generated in the inner space and a steep peak in the sound pressure level is generated, as shown by the thin solid line. In the case where the sound absorbing member is attached to the entire inner wall surface of the container, or in the case where the sound absorbing member is attached to the entire inner wall surface of the container and both surfaces of the glass diaphragm, the frequency characteristic becomes flat and the average sound pressure level is reduced, as shown by the single-dotted chain line or the thick solid line, respectively. On the other hand, in the case where the sound absorbing member is attached to both surfaces of the glass diaphragm and no sound absorbing member is attached to the inner wall surface of the container, the average sound pressure level is the same as in the state without the sound absorbing member, as shown by the dotted line, but the effect of preventing the generation of standing waves can make the sound pressure level peaks disappear, effectively reducing the noise generated in the internal space 19.

Therefore, from the viewpoint of acoustic performance, it is preferable to attach the sound absorbing member to the entire surface inside the enclosing member 15, more preferably to the entire surface inside the enclosing member 15 and both surfaces of the excitation region A1 of the glass diaphragm 11. In order to combine the cost of materials and installation with the expected acoustic effect, it is preferable to attach the sound absorbing member to at least one surface of the excitation region A1 of the glass diaphragm 11, more preferably to both surfaces of the excitation region A1 of the glass diaphragm 11.

(Sealing Member)

Figure 14:
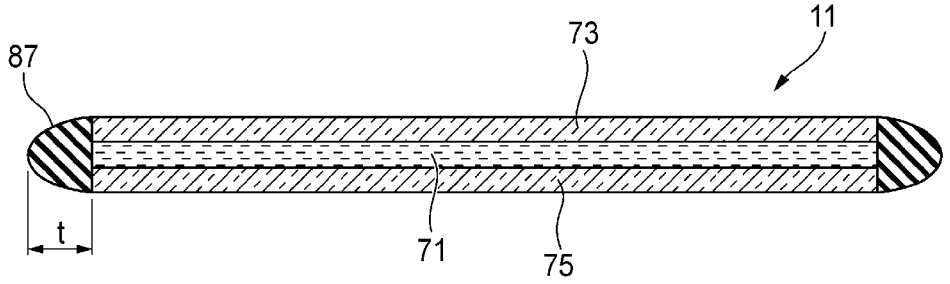
FIG. 14 is a sectional view of a glass vibrator that is provided with a sealing member at the edge.

As shown in FIG. 14, at least a part of the outer circumferential end surface of the glass diaphragm 11 may be sealed with a sealing member 87 that does not obstruct vibration of the glass diaphragm 11. The sealing member 87 may be made of a highly elastic rubber, resin, gel, or the like.

Figure 15:
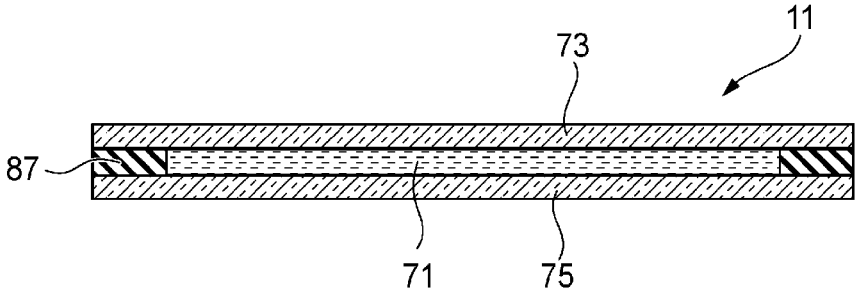
FIG. 15 is a sectional view of a glass vibrator in which at least a part of surfaces, opposed to each other, of glass sheets of a glass sheet composite is provided with a sealing member.

As shown in FIG. 15, the sealing member can be applied to at least a part of the surfaces of the glass sheet 73 and 75 facing each other for preventing peeling at the interface between the glass sheets 73 and 75 and the fluid layer 71 of the glass diaphragm 11 to the extent that the effect of the invention is not impaired. In this case, the area of the sealant application is preferably 20% or less of the area of the fluid layer 71, more preferably 10% or less, particularly preferably 5% or less so as not to interfere with vibration.

Example of resins that can be used for the sealing member 87 include an acrylic resin, a cyanoacrylate resin, an epoxy resin, a silicone resin, a urethane resin, and a phenol resin. Example setting methods are of a single liquid type, a two-liquid mixing type, a heat setting type, an ultraviolet setting type, and a visible light setting type. A hot-melt resin can also be used. Example of the materials include of an ethylene acetate vinyl type, a polyolefin type, a polyamide type, a synthetic rubber type, an acrylic type, and a polyurethane type. Examples of rubber include natural rubber, synthetic natural rubber, butadiene rubber, styrene-butadiene rubber, butyl rubber, nitrile rubber, ethylene-propylene rubber, chloroprene rubber, acrylic rubber, chlorosulfonated polyethylene rubber (Hypalon), urethane rubber, silicone rubber, fluororubber, ethylene-vinyl acetate rubber, epichlorohydrin rubber, polysulfide rubber (Thiokol), and hydrogenated nitrile rubber. When the thickness t of the sealing member 87 is too small, sufficient strength cannot be secured. When the thickness t is too thick, the sealing member 87 obstructs vibration. Thus, the thickness t of the sealing member 87 is preferably 10 μm or larger and less than or equal to five times the total thickness of the glass diaphragm. The thickness t of the sealing member 87 is even preferably 50 μm or larger and less than the total thickness of the glass diaphragm.

Figure 16A:
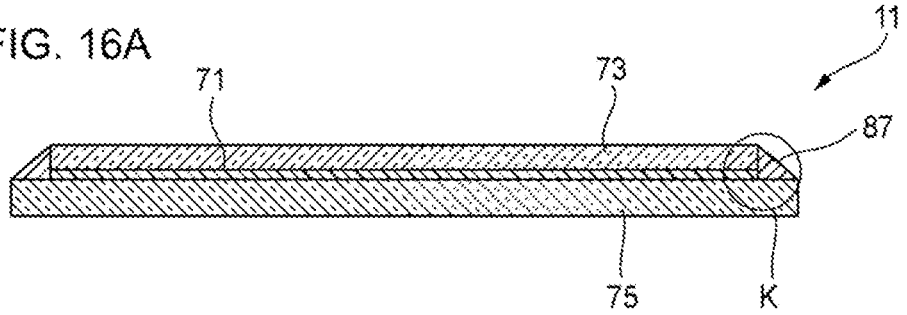
FIG. 16A is a sectional view of a glass vibrator having a step portion at the edge and FIG. 16B is an enlarged view of part K in FIG. 16A.
Figure 16B:
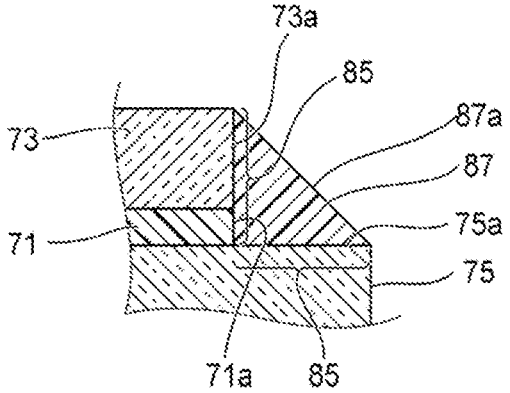

As shown in FIG. 16A and FIG. 16B, in the glass diaphragm 11, the glass sheets 73 and 75 have been disposed so that an edge surface of the two glass sheets are not flush with each other to constitute a step portion 85 having a stair-like shape in a cross-sectional view. A sealing member 87 is formed in the step portion 85 so as to seal at least the fluid layer 71.

In the step portion 85, the sealing member 87 is in close contact with an end surface 73*a* of the glass sheet 73, an end surface 71*a* of the fluid layer 71, and a major surface 75*a* of the glass sheet 75. With this structure, the fluid layer 71 is sealed with the sealing member 87, whereby leakage from the fluid layer 71 can be prevented. Furthermore, the joining between the glass sheet 73, the fluid layer 71, and the glass sheet 75 is strengthened, whereby the glass diaphragm is increased in strength.

Furthermore, in the step portion 85, the end surface 73*a* of the glass sheet 73 and the end surface 71*a* of the fluid layer 71 are perpendicular to the major surface 75*a* of the glass sheet 75. As a result, in a sectional view, the sealing member 87 has an outline that extends along the step portion 85 so as to assume an L shape. With this structure, the joining between the glass sheet 73, the fluid layer 71, and the glass sheet 75 is strengthened further, whereby the glass diaphragm is increased further in strength.

The sealing member 87 has a tapered surface 87*a*. In some case, the edge of the glass diaphragm is tapered or subjected to like working. The employment of the sealing member 87 having the above shape can provide the same effect as in the case where the glass diaphragm is worked in such a manner.

In addition, in the glass diaphragm 11 as shown in FIG. 16A and FIG. 16B, the end surfaces of the glass sheets 73 and 75 are not flush with each other and the sealing member 87 is formed in the step portion 85. Thus, in the glass diaphragm, the sealing member 87 is located behind the glass sheet 75 and hence is not seen when viewed from the side of the glass sheet 75. This enhances the design performance of the glass diaphragm.

Figure 17:
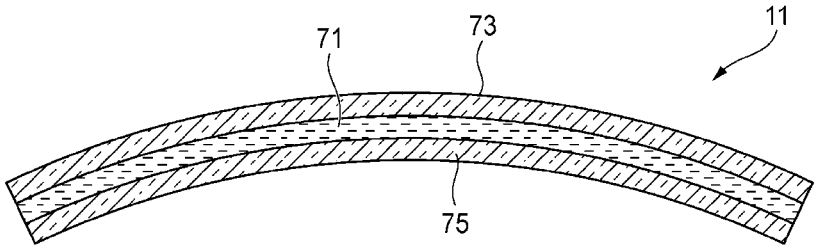
FIG. 17 is a sectional view of a curved glass vibrator.

The glass diaphragm may have a planar shape or such a curved shape as to be curved (bent) to conform to an installation place as shown in FIG. 17. Alternatively, although not shown in any drawing, the glass v diaphragm may be shaped so as to have both of a planar portion and a curved portion. That is, the glass vibrator G may have a three-dimensional shape including a curved portion that is curved to assume a concave shape or a convex shape at least partially. By having a three-dimensional shape that conforms to an installation place, it can be given a good appearance in the installation place and hence can be enhanced in design performance.

Figure 18A:
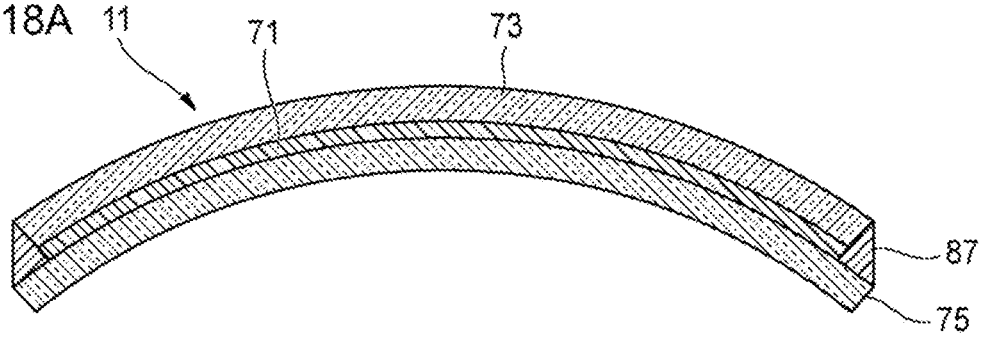
FIG. 18A and FIG. 18B show glass vibrators having a step portion at the edge.
Figure 18B:
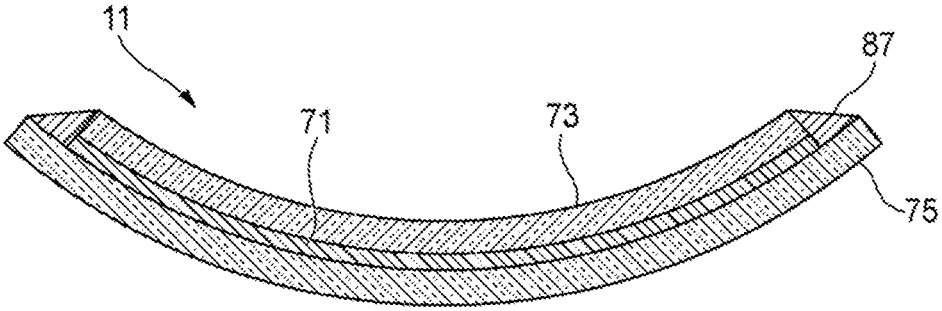

Furthermore, the glass diaphragm in which the outer edge step portion 85 is sealed with the sealing member 87 may be given a curved shape (three-dimensional shape) so that the glass sheet 75 side is recessed as shown in FIG. 18A. In this case, an outer edge of the glass sheet 75 projects outward beyond the glass sheet 73. Alternatively, as shown in FIG. 18B, the glass diaphragm may be given a curved shape that is an inverted version of the shape shown in FIG. 18A. Also in this case, an outer edge of the glass sheet 75 projects outward beyond the glass sheet 73.

Also in these glass diaphragm, the sealing member 87 is located behind the glass sheet 75 and hence is not seen when viewed from the side of the glass sheet 75. As a result, each glass diaphragm can be given a good appearance in an installation place and hence can be enhanced in the design performance of itself.

In the case where the vibration device is constructed using plural glass sheets as in the cases of the glass diaphragms shown in FIG. 10 to FIG. 12B and FIG. 14 to FIG. 18B, the excitation region in which the exciters are attached may be formed using a single glass sheet.

Figure 19:
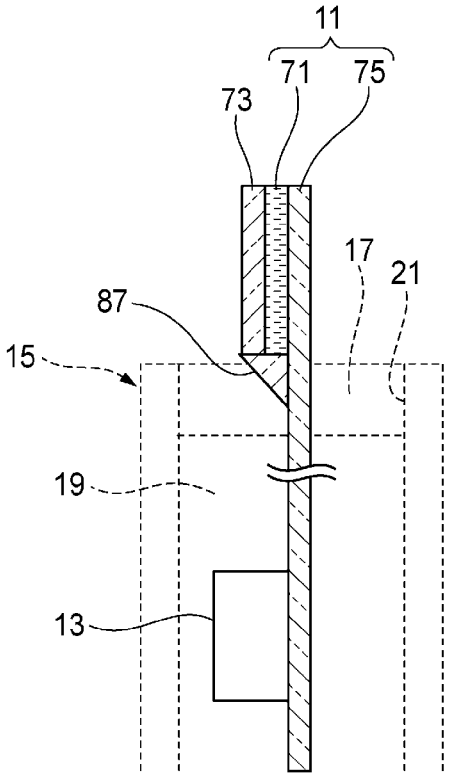
FIG. 19 is a partially sectional view showing how an exciter is attached to a glass diaphragm whose excitation region is formed by a single glass sheet.

FIG. 19 is a partially sectional view showing how the exciter 13 is attached to a glass diaphragm 11 whose excitation region is formed by a single glass sheet.

Of the pair of glass sheets 73 and 75 of the glass diaphragm 11, the glass sheet 75 extends outward beyond the outer edge of the glass sheet 73. The exciter 13 is attached to the outward extended portion which extends outward beyond the outer edge of the glass sheet 73. End portions of the glass sheet 73 and the fluid layer 71 are provided with a sealing member 87 as mentioned above, whereby the fluid layer 71 is sealed.

In this configuration, since the exciter 13 vibrates the single glass sheet 75, the glass diaphragm 11 can be excited with higher energy efficiency than in a case of vibrating plural glass sheets at the same time.

The invention is not limited to the above embodiments. Combining individual structures of embodiments and acts that those skilled in the art make changes and applications on the basis of the disclosure of the specification and known techniques are expected by the invention and included in the scope of protection.

Although the above-described internal space 19 is defined by the enclosing member, it may be defined utilizing an installation target member on which the vibration device is installed. For example, a vibration device may be constructed using a structural member such as a chassis or a body of an automobile as an enclosing member or using a groove or a recess formed in such a structural member as an internal space.

As described above, the specification discloses the following items:

(1) A vibration device including:

a glass diaphragm;

an exciter which is fixed to the glass diaphragm and vibrates the glass diaphragm;

an enclosing member which defines an internal space by enclosing a portion, including a fixing position of the exciter, of the glass diaphragm, one end portion of the glass diaphragm being exposed to outside the internal space through an opening of the internal space; and a shielding member for acoustic shielding between the opening and the glass diaphragm, the shielding member dividing the glass diaphragm into an excitation region located inside the internal space and a vibration region located outside the internal space.

In this vibration device, the excitation region, provided with the exciter, of the glass diaphragm is located inside the internal space defined by the enclosing member and is partitioned by the shielding member. When acoustic radiation is emitted from the vibration region of the glass diaphragm located outside the internal space (i.e., the one end portion exposed to outside the internal space through the opening of the internal space) by vibration of the exciter, a uniform sound pressure distribution is formed. Furthermore, since no noise leakage occurs from the internal space, reduction in directivity can be suppressed.

(2) The vibration device according to item (1), wherein when a direction in which the glass diaphragm projects outward from inside the internal space is referred to as a first direction and a direction that is perpendicular to the first direction in a plate plane is referred to as a second direction, a maximum width of the glass diaphragm in the second direction is longer than or equal to a maximum width in the first direction.

According to this vibration device, the distance from the exciter disposed in the excitation region of the glass diaphragm does not become too long at any point in the entire surface of the vibration region and hence vibration generated by the exciter travels to the vibration region while being kept sufficiently strong.

(3) The vibration device according to item (1) or (2), wherein a sound absorbing member that is 0.25 or larger in normal-incidence sound absorption ratio is attached to all or part of inside surfaces of the enclosing member.

According to this vibration device, the frequency characteristic is made flat and the average sound pressure level is lowered, whereby the silencing effect is enhanced.

(4) The vibration device according to any one of items (1) to (3), wherein a sound absorbing member that is 0.25 or larger in normal-incidence sound absorption ratio is attached to all or a part of at least one surface of the excitation region of the glass diaphragm.

According to this vibration device, since generation of a standing wave is suppressed, the sound pressure level in the internal space can be lowered.

(5) The vibration device according to any one of items (1) to (4), wherein a ratio Ss/Sv of an area Ss of the excitation region of the glass diaphragm to an area Sv of the vibration region of the glass diaphragm is 0.01 or larger and 1.0 or less.

According to this vibration device, efficient excitation driving can be realized without lowering the efficiency of generation of a sound pressure by acoustic radiation emitted from the vibration region A2 according to vibration generated by the exciter.

(6) The vibration device according to any one of items (1) to (5), wherein a total area of the glass diaphragm is 0.01 $m^2$ or larger.

According to this vibration device, the effect of forming a uniform sound pressure distribution and the effect of suppressing reduction in directivity can be obtained more easily by dividing the excitation region and the vibration region from each other.

(7) The vibration device according to any one of items (1) to (6), including a support member which allows the enclosing member to support the glass diaphragm.

In this vibration device, the glass diaphragm is supported by the enclosing member via the support member.

(8) The vibration device according to item (7), wherein the support member supports the glass diaphragm so that the glass diaphragm is movable relative to the enclosing member.

According to this vibration device, the areas of the excitation region and the vibration region can be varied by causing the glass diaphragm to make a relative movement.

(9) The vibration device according to any one of items (1) to (8), wherein the exciters are disposed at plural positions of the glass diaphragm.

According to this vibration device, the distribution of vibration in the vibration region can be increased in uniformity by applying vibration to the glass diaphragm from plural exciters.

(10) The vibration device according to any one of items (1) to (9), wherein the exciter is disposed on only one surface of the glass diaphragm.

According to this vibration device, the exciters can be arranged efficiently in the case where an exciter arrangement space is restricted in the thickness direction of the glass diaphragm.

(11) The vibration device according to any one of items (1) to (9), wherein the exciters are disposed on both surfaces of the glass diaphragm.

According to this vibration device, the exciters can be arranged efficiently in the case where the glass diaphragm is restricted in area.

(12) The vibration device according to any one of items (1) to (11), wherein the shielding member has a storage modulus measured at 25° C. at a frequency 1 Hz of $1.0\times10^{2}$ to $1.0\times10^{10}$ Pa.

This vibration device can prevent sound leakage while suppressing attenuation of vibration of the glass diaphragm.

(13) The vibration device according to any one of items (1) to (12), wherein the glass diaphragm has flat-plate shape.

According to this vibration device, working into the glass diaphragm can be performed easily and hence cost reduction can be attained.

(14) The vibration device according to any one of items (1) to (12), wherein at least part of the glass diaphragm has a concave or convex curved surface.

According to this vibration device, the shape of the glass diaphragm can be set freely according to a position and purpose of installation of the vibration device.

(15) The vibration device according to any one of items (1) to (14), wherein the glass diaphragm has plural glass sheets, and a fluid layer containing a liquid is provided between at least a pair of glass sheets that are adjacent to each other.

According to this vibration device, when resonance has occurred in one glass sheet, resonance of the other glass sheet can be prevented. Furthermore, resonance shaking of the glass sheets can be attenuated.

(16) The vibration device according to any one of item (15), wherein the excitation region of the glass diaphragm is formed by a single glass sheet.

According to this vibration device, the glass diaphragm can be excited at high energy efficiency.

(17) The vibration device according to any one of items (1) to (16), wherein the glass diaphragm has a loss coefficient at 25° C. of the glass diaphragm of $1\times10^{-3}$ or larger and a longitudinal wave acoustic velocity in a thickness direction of the glass diaphragm of $4.0\times10^{3}$ m/s or larger.

According to this vibration device, the degree of attenuation of vibration can be increased by increasing the loss coefficient and the reproducibility of a sound in a radio-wave frequency range can be enhanced by increasing the longitudinal wave acoustic velocity.

Although the invention has been described above in detail by referring to the particular embodiments, it is apparent that to those skilled in the art that various changes and modifications are possible without departing from the spirit and scope of the invention.

DESCRIPTION OF SYMBOLS

11, 11A, 11B, 11C, 11D, 11E: Glass diaphragm
11*a*: Through-hole
13: Exciter
15, 15A, 15B: Enclosing member
15*a*: Through-hole
17: Shielding member
19: Internal space
21: Opening
23, 23A, 23B: Support member
71: Fluid layer
73, 75, 77: Glass sheet
100: Vibration device
A1: Excitation region
A2: Vibration region

The invention claimed is:

1. A vibration device comprising:
a glass diaphragm;
an exciter which is fixed to the glass diaphragm and vibrates the glass diaphragm;
an enclosing member which defines an internal space by enclosing a portion, including a fixing position of the exciter, of the glass diaphragm, one end portion of the glass diaphragm being exposed to outside the internal space through an opening of the internal space; and
a shielding member for acoustic shielding between the opening and the glass diaphragm, the shielding member dividing the glass diaphragm into an excitation region located inside the internal space and a vibration region located outside the internal space, wherein a ratio Ss/Sv of an area Ss of the excitation region of the glass diaphragm to an area Sv of the vibration region of the glass diaphragm is 0.01 or larger and 1.0 or less.

2. The vibration device according to claim 1, wherein when a direction in which the glass diaphragm projects outward from inside the internal space is referred to as a first direction and a direction that is perpendicular to the first direction in a plate plane is referred to as a second direction, a maximum width of the glass diaphragm in the second direction is longer than or equal to a maximum width in the first direction.

3. The vibration device according to claim 1, wherein a sound absorbing member that is 0.25 or larger in normal-incidence sound absorption ratio is attached to all or a part of inside surfaces of the enclosing member.

4. The vibration device according to claim 1, wherein a sound absorbing member that is 0.25 or larger in normal-incidence sound absorption ratio is attached to all or a part of at least one surface of the excitation region of the glass diaphragm.

5. The vibration device according to claim 1, wherein a total area of the glass diaphragm is 0.01 $m^2$ or larger.

6. The vibration device according to claim 1, comprising a support member which allows the enclosing member to support the glass diaphragm.

7. The vibration device according to claim 6, wherein the support member supports the glass diaphragm so that the glass diaphragm is movable relative to the enclosing member.

8. The vibration device according to claim 1, wherein the exciters are disposed at plural positions of the glass diaphragm.

9. The vibration device according to claim 1, wherein the exciter is disposed on only one surface of the glass diaphragm.

10. The vibration device according to claim 1, wherein the exciters are disposed on both surfaces of the glass diaphragm.

11. The vibration device according to claim 1, wherein the shielding member has a storage modulus at 25° C. at a frequency 1 Hz of $1.0\times10^{2}$ to $1.0\times10^{10}$ Pa.

12. The vibration device according to claim 1, wherein the glass diaphragm has flat-plate shape.

13. The vibration device according to claim 1, wherein at least a part of the glass diaphragm has a concave or convex curved surface.

14. The vibration device according to claim 1, wherein the glass diaphragm comprises plural glass sheets, and a fluid layer containing a liquid is provided between at least a pair of glass sheets that are adjacent to each other.

15. The vibration device according to any one of claim 14, wherein the excitation region of the glass diaphragm is formed by a single glass sheet.

16. The vibration device according to claim 1, wherein the glass diaphragm has a loss coefficient at 25° C. of $1\times10^{-3}$ or larger and a longitudinal wave acoustic velocity in a thickness direction of the glass diaphragm of $4.0\times10^{3}$ m/s or larger.

17. A vibration device comprising:

a glass diaphragm;

an exciter which is fixed to the glass diaphragm and vibrates the glass diaphragm;

an enclosing member which defines an internal space by enclosing a portion, including a fixing position of the exciter, of the glass diaphragm, one end portion of the glass diaphragm being exposed to outside the internal space through an opening of the internal space; and a shielding member for acoustic shielding between the opening and the glass diaphragm, the shielding member dividing the glass diaphragm into an excitation region located inside the internal space and a vibration region located outside the internal space, wherein a total area of the glass diaphragm is 0.01 $m^2$ or larger.

18. A vibration device comprising:

a glass diaphragm;

an exciter which is fixed to the glass diaphragm and vibrates the glass diaphragm;

an enclosing member which defines an internal space by enclosing a portion, including a fixing position of the exciter, of the glass diaphragm, one end portion of the glass diaphragm being exposed to outside the internal space through an opening of the internal space; and a shielding member for acoustic shielding between the opening and the glass diaphragm, the shielding member dividing the glass diaphragm into an excitation region located inside the internal space and a vibration region located outside the internal space, wherein at least a part of the glass diaphragm has a concave or convex curved surface.

* * * * *